US006598662B2

(12) United States Patent
Kato et al.

(10) Patent No.: US 6,598,662 B2
(45) Date of Patent: Jul. 29, 2003

(54) MOLTEN STEEL SUPPLYING APPARATUS FOR CONTINUOUS CASTING AND CONTINUOUS CASTING METHOD THEREWITH

(75) Inventors: Toru Kato, Kashima (JP); Norihiro Nishida, Shimodate (JP); Masashi Hara, Tonosho-machi (JP); Masayuki Kawamoto, Wakayama (JP); Toshihiko Murakami, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/216,772

(22) Filed: Aug. 13, 2002

(65) Prior Publication Data

US 2003/0006022 A1 Jan. 9, 2003

Related U.S. Application Data

(63) Continuation of application No. PCT/JP01/11409, filed on Dec. 25, 2001.

(30) Foreign Application Priority Data

| | | |
|---|---|---|
| Dec. 25, 2000 | (JP) | 2000-392252 |
| Jun. 11, 2001 | (JP) | 2001-175722 |
| Aug. 15, 2001 | (JP) | 2001-246524 |

(51) Int. Cl.[7] ..... B22D 11/10; B22D 27/02

(52) U.S. Cl. ..... 164/488; 164/48; 164/437; 164/492; 164/505

(58) Field of Search ..... 164/492, 48, 495, 164/497, 505, 508, 514, 515, 488, 437

(56) References Cited

U.S. PATENT DOCUMENTS 4,850,572 A * 7/1989 Cure ..... 266/44

FOREIGN PATENT DOCUMENTS

| | | |
|---|---|---|
| JP | 51-50922 | 5/1976 |
| JP | 55-130364 | * 10/1980 |
| JP | 56-18168 | 2/1981 |
| JP | 04-319055 | 11/1992 |
| JP | 04-322870 | 11/1992 |
| JP | 06-182513 | 7/1994 |

OTHER PUBLICATIONS

Journal of The Iron And Steel Institute of Japan, Tetsu-to-Hagane, No. 11, vol. 66, Sep. 1980, pp. 267–268.

* cited by examiner

*Primary Examiner*—Kuang Y. Lin
(74) *Attorney, Agent, or Firm*—Clark & Brody

(57) ABSTRACT

An apparatus for supplying molten steel and a continuous casting method therewith are described. The apparatus is equipped with a tundish 1 having an upper nozzle 2 at the bottom, a flow control mechanism 3 disposed below the upper nozzle 2, an immersion nozzle 4 formed by a refractory material having a good electrical conductivity, one electrode 5 disposed in the inner space of the tundish 1, the other electrode 6 disposed in the immersion nozzle 4, and a power supply 7 connected to the electrodes 5 and 6. In the method, the molten steel is supplied into a mold in the state of supplying an electric current between the inner surface of the immersion nozzle 4 and the molten steel 8 passing through the inside thereof by utilizing the apparatus for supplying molten steel. The deposition of the Al oxide or the like in the molten steel onto the inner surface of the immersion nozzle and others can be prevented, and thereby the generation of the surface defects in the products can also be prevented.

16 Claims, 5 Drawing Sheets

MOLTEN STEEL SUPPLYING APPARATUS FOR CONTINUOUS CASTING AND CONTINUOUS CASTING METHOD THEREWITH

This application is a continuation of International Application No. PCT/JP01/11409, filed Dec. 25, 2001.

TECHNICAL FIELD

The present invention relates to an apparatus for supplying molten steel used for the continuous casting, and also to a method for continuously casting with the apparatus for supplying molten steel, which is useful to prevent an immersion nozzle clogging and to reduce slab surface defects.

BACKGROUND ART

As a method for continuously producing a slab, a continuous casting method is normally known, in which molten steel stored in a tundish is supplied to a top of a mold via an immersion nozzle disposed at the lower part of the tundish to form a solidified shell in the mold, and then the slab is continuously produced by withdrawing the solidified shell from a bottom of the mold.

When the molten steel, which is deoxidized with Al, is continuously cast, the Al oxide in the molten steel tends to deposit to the inner surface of the immersion nozzle, and therefore the molten steel is hindered to flow in the immersion nozzle. Therefore, when the casting is carried out using an immersion nozzle having more than one port, a symmetric flow of the molten steel in the mold cannot be obtained. In fact, when a bias flow becomes to be great, a fluid flow in the mold tends to an asymmetric flow. Accordingly, when such an asymmetric flow is generated, a mold flux on a meniscus of the molten steel in the mold is liable to be entrapped into the molten steel, and/or Al oxide or the like, deposited to the inner surface of the immersion nozzle, is peeled off and then tends to be entrapped into the molten steel.

The mold flux and Al oxide or the like entrapped in the molten steel are trapped by the solidified shell in the mold, thus slab surface defects such as powder defect and/or slag spot are liable to occur. The defects on the slab surface cause surface defects in the products, when the slab having the slab surface defects is hot-rolled.

When the amount of Al oxide deposited on the inner surface of the immersion nozzle increases, the so-called nozzle clogging takes place, so that it is difficult to continue the casting. The cleaning of the inner surface of the immersion nozzle with oxygen gas may solve the problem of nozzle clogging. Nevertheless, this deteriorates a cleanliness of the steel.

A method for purging an inert gas into molten steel passing through an immersion nozzle in order to avoid the nozzle clogging has been known ("Tetsu To Hagane", vol. 66, S868, Iron and Steel Institute of Japan), and various methods for preventing nozzle clogging, which are applicable to the casting, have recently been proposed. For instance, a method for purging an inert gas into molten steel passing through an immersion nozzle is proposed in Japanese Patent Application Laid-open No. H4-319055, in which case, the amount (liter (Nl)/min) of the inert gas to be blown into the molten steel is adjusted in accordance with the throughput (t/min) of the molten steel passing through the immersion nozzle.

In Japanese Patent Application Laid-open No. H6-182513, moreover, a method for purging an inert gas into molten steel, wherein an AC or DC current is supplied between a porous refractory material for purging gas on the inner wall of an immersion nozzle and the molten steel passing through the immersion nozzle. In this method, the deposition of Al oxide or the like onto the inner surface of the immersion nozzle is prevented by purging the inert gas into the molten steel. At the same time, by supplying a current between the inner wall of the immersion nozzle and the molten steel, the resulting electromagnetic force applied to the molten steel promotes bubbles of the purged inert gas to remove form the refractory material for the purging gas, and thereby to reduce the size of generated gas bubbles. As a result, the size of the gas bubbles, which are trapped by the solidified shell in the mold, is reduced, thereby enabling the defects due to the gas bubbles in the slab to prevent on the surface of products, which are manufactured by hot-rolling the slab.

However, in the methods proposed in these specifications, it is found that a decrease in the amount of the purged inert gas to prevent the gas bubble trapping by the solidified shell makes it difficult to prevent the Al oxide or the like in the molten steel from depositing onto the inner surface of the immersion nozzle. On the contrary, the suppression of the deposition of the Al oxide or the like in the molten steel onto the inner surface of the immersion nozzle provides an increase in the amount of the purged gas. Thus the bubbles of the inert gas are trapped more extent by the solidified shell, thereby a greater number of the surface defects are generated in the products.

In these conventional methods, therefore, it is impossible to securely prevent the deposition of Al oxide or the like in the molten steel onto the inner surface of the immersion nozzle. Moreover, even if the deposition of Al oxide or the like in the molten steel onto the inner surface of the immersion nozzle is successfully prevented, the defects due to the gas bubbles generates on the surface of the slab, thereby resulting in the generation of the surface defects on the products. From this viewpoint, it is desirable to provide a secure and effective method for preventing the Al oxide or the like in the molten steel from being deposited on the inner surface of an immersion nozzle.

DISCLOSURE OF INVENTION

Accordingly, it is the object of the present invention to provide an apparatus for supplying molten steel, which effectively prevents Al oxide or the like in molten steel from being deposited onto the inner surface of an immersion nozzle, thereby enabling the generation of the slab surface defects due to mold flux, Al oxide or the like to be prevented, and at the same time enabling the surface defects of products produced from the slab to be effectively prevented. It is another object of the present invention to provide a method for continuously casting with the apparatus for supplying the molten steel.

In order to attain the above objects, the present inventors focused on the electrical capillarity and then developed a method for preventing the Al oxide or the like in the molten steel from being deposited on the inner surface of an immersion nozzle by utilizing the electrical capillarity. The electrical capillarity described herein implies a phenomenon in which the interfacial tension between an ion solution and an electrode immersed therein can be changed by the potential applied to the electrode. The present inventors carefully investigated the phenomenon and succeeded in finding the following features [1] to [7]:

[1] An upper nozzle, a flow control mechanism and an immersion nozzle of a continuous casting apparatus are constituted by a refractory material which exhibits either the electronic conductivity or the ion conductivity at a high temperature. As a result, the application of a potential between the molten steel and the refractory material having either the electronic conductivity and/or the ion conductivity at a high temperature during the continuous casting provides the electrical capillarity on the interfacial surface therebetween. This reduces interfacial tension, so that the depositing force of the Al oxide or the like on the surface of the refractory material is reduced, thereby making it difficult to deposit the Al oxide or the like on the surface of the refractory material.

[2] On the basis of the above presumption, an experiment was carried out wherein, employing a crucible in the laboratory use, an electrode and a refractory material rod both having a good electrical conductivity were immersed in molten steel, and a potential was applied between the refractory material rod and the electrode by supplying a current therebetween. In this experiment, it was found that the build up of the Al oxide or the like in the molten steel on the inner surface of the refractory material was reduced even in the case of a small potential, and that, irrespective of the polarity of the applied potential, an increase in the absolute value of the potential correspondingly reduced the build up of the Al oxide or the like on the surface of the refractory material.

[3] On the basis of the above experimental results, a method for preventing Al oxide or the like in the molten steel from being deposited onto the inner surface of an immersion nozzle was investigated. In order to more effectively supply a current between the refractory material having a good electrical conductivity and the molten steel passing through the immersion nozzle, the effect of the electrical insulation between paired electrodes was studied. The refractory material used for the electrical insulation normally provides a satisfactory result, if it has an electrical resistivity (specific resistance) of not less than $1\times10^5$ Ω·m at room temperature. However, at such a high temperature as in the molten steel, the refractory material exhibits greater ion conductivity, thereby greatly reducing the electrical resistivity and deteriorating the electrical insulation.

[4] When the electrical insulation between the paired electrodes is reduced due to the above-mentioned feature [3], no sufficient current can pass through the molten steel stream inside the immersion nozzle and thereby partial currents flow in the short circuits to materials other than the molten steel, thereby making it impossible to prevent the material such as Al oxide or the like in the molten steel from being deposited onto the inner surface of the immersion nozzle. This provides not only a waste of the supplied electric power, but also a danger of generating fine discharges due to the partial currents leaked to the exterior, as well as of both receiving an electric shock and providing the malfunction of the surrounding instruments.

[5] When a tundish is preheated or when a tundish is hot-recycled without preheating, by presetting the initial electrical resistance between paired electrodes at not less than 500Ω just before the molten steel is supplied to the tundish, sufficient current can flow in the molten steel passing through the immersion nozzle during the whole casting period from the start to the end of casting, and making it possible to prevent the currents from flowing into the short circuits to the materials other than the molten steel. The above-mentioned term "during the period from the start to the end of casting" is generally 60 to 500 min., dependent on the type of the continuous casting machine, the size of slab, the casting rate, the number of heats in continuous casting and so on.

[6] It is preferable that the electrical resistance in the period from the start to the end of casting, said resistance being calculated from the current and voltage between the paired electrodes, is less than 1/10 of the initial electrical resistance between one electrode and the other electrode, which is the value of the resistance either at the end of preheating before the molten steel is supplied to the tundish or before the molten steel is supplied to the tundish if the tundish which is once used for casting is recycled without preheating.

[7] In other words, the feature [6] implies that the electrical resistance calculated by the current and voltage between the paired electrodes in the electric circuit constituted by the molten steel stream inside the immersion nozzle gradually increases in the course of the casting. If the electrical resistance during the casting further increases after the end of the gradual increase, no sufficient current can pass through the molten steel stream inside the immersion nozzle, and therefore the partial currents begin to flow to the short circuits constituted by the materials other than the molten steel. By controlling the electrical resistance in the course of casting to the end of casting in such a way that it can be set to be less than 1/10 of the initial electrical resistance between one electrode and the other electrode just before the molten steel is supplied to the tundish, the electrical current can be sufficiently passed through the molten steel stream inside the immersion nozzle, thereby making it possible to suppress the partial currents to short circuits constituted by the materials other than the molten steel.

Accordingly, the present invention is completed on the basis of the above-mentioned features and it is characterized by an apparatus for supplying molten steel defined by the following structural arrangement (1) or (2) as well as by a continuous casting method defined by the following structural arrangements (3) to (7):

(1) An apparatus for supplying molten steel used for the continuous casting, characterized in that said apparatus comprising a tundish for storing the molten steel, an upper nozzle disposed in the bottom of the tundish, a flow control mechanism for controlling the flow rate of the molten steel from the tundish into a mold and an immersion nozzle for supplying the molten steel into the mold, wherein providing a pair of electrodes and a power supply connected thereto, and forming the inner surface, being in contact with the molten steel, of one of the upper nozzle, the flow control mechanism and the immersion nozzle, by a refractory material having a good electrical conductivity at a temperature not less than the melting point of steel, wherein the one electrode of the paired electrodes is disposed in one of the tundish, the upper nozzle, the flow control mechanism and the immersion nozzle in such a way that the one electrode reaches the inner space of thereof and is in contact with the molten steel, wherein disposing the other electrode in a part formed by the refractory material having a good electrical conductivity.

(2) In the apparatus for supplying molten steel having the above-mentioned structural arrangement (1), it is preferable that the refractory material having a good electrical conductivity has a conductivity of not less than $1\times10^3$ S/m at the melting point of steel and/or comprises an alumina graphite. Moreover, in the molten steel supplying apparatus having the above structural arrangement (1), it is preferable that an insulating element is interposed between the one electrode and the other electrode and/or that a gas purging part is provided in one of the upper nozzle, the flow control mechanism and the immersion nozzle which have no electrode.

(3) A continuous casting method, characterized in that supplying a molten steel stored in a tundish into a mold using the apparatus for supplying molten steel having the above-mentioned structural arrangements (1) and (2), whereby supplying an electric current between the inner surface of the upper nozzle, the flow control mechanism and the immersion nozzle in which the other electrode of the paired electrodes is disposed and the molten steel passing through the inside thereof.

(4) A continuous casting method, characterized in that, in the case of supplying a molten steel stored in a tundish into a mold using the apparatus for supplying a molten steel, having the above-mentioned structural arrangements (1) and (2), whereby setting the electrical resistance between the one electrode and the other electrode to be not less than 500Ω, either at the end of preheating the tundish before the molten steel is supplied to the tundish, or before the molten steel is supplied to the tundish if the tundish which is once used for casting is recycled for casting without preheating.

(5) In the continuous casting method having the above-mentioned structural arrangement (4), it is preferable that the electrical resistance determined from the current and voltage applied between the one electrode and the other electrode during a period from the start and to the end of casting is set to be less than 1/10 of the electrical resistance between the one electrode and the other electrode, either at the end of the preheating of the tundish before the molten steel is supplied to the tundish, or before the molten steel is supplied to the tundish if the tundish which is once used for casting is recycled for casting without preheating.

(6) In the continuous casting method having the above-mentioned structural arrangements (3) to (5), it is preferable that an electrical current is supplied at a current density of not less than 0.001 A/cm$^2$ and less than 0.3 A/cm$^2$ and/or that the applied voltage is not less than 0.5 V and not more than 100 V.

(7) A continuous casting method, characterized in that, in the case of supplying a molten steel stored in a tundish into a mold using the apparatus for supplying molten steel, having the above-mentioned structural arrangements (1) and (2), whereby forming at least the immersion nozzle by a refractory material having a good electrical conductivity at a temperature not less than the melting point of steel, disposing the other electrode therein, applying a negative potential is applied to the immersion nozzle and supplying a DC current between the immersion nozzle and the molten steel passing through the inside of the immersion nozzle to prevent the immersion nozzle from being stopped up.

In accordance with the present invention, the material for producing the immersion nozzle and the like is selected from refractory materials having a good electrical conductivity at a temperature not less than the melting point of steel. This is due to the necessity of flowing the electrical current between the refractory material and the molten steel. In the following description, the expression "a material having a good electrical conductivity at a temperature not less than the melting point of steel" will be sometimes abbreviated by an expression "a material having a good electrical conductivity".

The expression "at the end of the preheating of the tundish before the molten steel is supplied to the tundish", which is defined in the above structural arrangements (4) and (5) according to the present invention, means the following:

The refractory materials disposed in the tundish, as well as the refractory materials included in the upper nozzle, the gate for controlling the amount of the molten steel to be supplied into the mold, the immersion nozzle and the like are normally preheated by the combustion gas, before starting the continuous casting by supplying the molten steel into the tundish. This is due to the fact that the refractory materials may be damaged by a thermal shock in the case of pouring the molten steel into the tundish and mold, and that the initially supplied molten steel solidifies on the refractory material, and such an undesirable damage must be avoided. In this case, the surface temperature of these refractory materials at the end of preheating should be typically 800 to 1,300° C. However, the target temperature on the surface of the refractory materials after preheating depends on the casting work conditions, such as the capacity of the tundish, the time between the start of supplying the molten steel into the tundish and the start of supplying the molten steel into the mold, and others.

The electric circuit between the paired electrodes at the end of preheating in the state of the molten steel being not yet supplied to the tundish includes the refractory materials disposed in the tundish, the refractory materials constituting the upper nozzle, the gate and the immersion nozzle, and a steel structure for supporting these refractory materials. The electrical resistance of the refractory materials and the steel structure normally decrease with the increase of the temperature.

From these facts, the expression "the electrical resistance between the one electrode and the other electrode in the end of preheating" implies an electrical resistance between the one electrode and the other electrode in an electrical circuit, which may be constituted by refractory elements in a tundish heated at a target surface temperature, refractory such as upper nozzle, a gate and an immersion nozzle, and a steel construction for supporting these refractory materials, so that it implies the electrical resistance minimized just before starting to supply the molten steel into the tundish. In the following description, this electrical resistance will be sometimes denoted by "an initial electrical resistance".

Similarly, the expression "the electrical resistance between the one electrode and the other electrode before supplying the molten steel into the tundish when the tundish which is once used for casting is recycled for casting without preheating", which is defined in the above structural arrangements (4) and (5) according to the present invention, implies the following facts:

In recent years, from the viewpoint of reducing the energy cost, the so-called hot tundish recycling, in which the tundish is recycled without cooling, is employed. In this case, two methods can be applied; in the one method, the tundish is preheated, and in the other method, new molten steel is supplied into the tundish without preheating. In the case of non-preheating, the surface temperature of the refractory materials in the tundish is 1,000 to 1,400° C. The above-mentioned electrical resistance means the electrical resistance between the one electrode and the other electrode in an electric circuit which is constituted by the above-mentioned refractory materials and the steel structure at such a high temperature, and therefore it means the electrical resistance just before the molten steel is supplied to the tundish. In other words, it means the initial electrical resistance.

The expression "the electrical resistance which is determined by the current and voltage between the one electrode and the other electrode during the time interval from the start to the end of casting" defined in the above structural arrangement (5) according to the present invention means an electrical resistance between the one electrode and the other electrode in an electrical circuit of the molten steel supplied into the tundish. Such an electrical resistance in the electrical circuit of the molten steel increases with the increase of the casting time. Hereafter, this electrical resistance is denoted in some cases by "the electrical resistance during the casting".

BEST MODE FOR CARRYING OUT THE INVENTION

An apparatus for supplying molten steel according to the present invention and a continuous casting method according to the present invention will be described as for the following items: The structural arrangement of the apparatus, the refractory materials having a good electrical conductivity, the implementation of electrical insulation, the purging of gas, the application of a current and voltage, and a negative potential applied to an immersion nozzle.

1. The Structural Arrangement of the Apparatus

Figure 1:
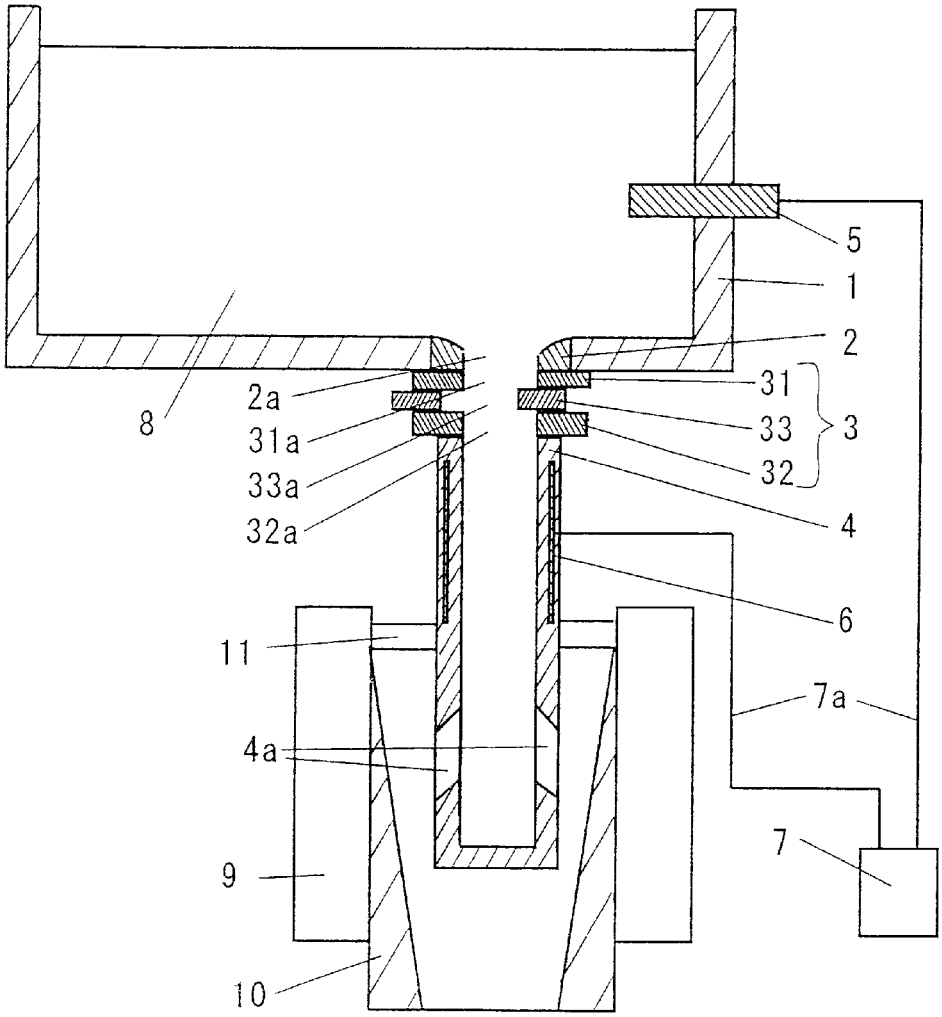
FIG. 1 is a longitudinal sectional view schematically showing an embodiment of an apparatus for supplying molten steel according to the present invention.

Referring now to FIGS. 1 to 4, the structural arrangement of an apparatus for supplying molten steel according to the present invention will be described. FIG. 1 is a longitudinal sectional view schematically showing an embodiment of the apparatus for supplying molten steel according to the present invention. In FIG. 1, a three-layer type-sliding gate is shown as for a molten steel flow control mechanism. However, the present invention is not restricted to the sliding gate of this type. For instance, a double layer type sliding gate and/or a flow control mechanism using a stopper can be employed.

In FIG. 1, the apparatus for supplying molten steel comprises a tundish 1 having an upper nozzle 2 at its bottom, a sliding gate 3 disposed beneath the upper nozzle 2, an immersion nozzle 4 connected to the sliding gate 3, one electrode 5 disposed at the sidewall of the tundish 1, the other electrode 6 disposed at the immersion nozzle 4 and a power supply 7 connected to both the one electrode 5 and the other electrode 6. The shape of the tundish 1 for receiving the molten steel 8 and the lining made of a refractory material are not for special use, but those for conventional use.

The upper nozzle 2 disposed at the bottom of the tundish 1 is made of a refractory material, and has an exit hole 2*a* for supplying the molten steel 8 stored in the tundish 1 downwards. The sliding gate 3 has a three-layer structure comprising an upper plate 31, a lower plate 32 and a movable plate 33 disposed therebetween. The upper plate 31, the lower plate 32 and the movable plate 33 are made of a refractory material and each has a hole 31*a*, 32*a* or 33*a*. The flow rate of the molten steel 8 supplied downwards can be controlled by a horizontal displacement of the movable plate 33 actuated by a driving mechanism (not shown).

The immersion nozzle 4 is equipped with two exit ports 4*a* at its lower position, and a part of the immersion nozzle 4 where the exit ports 4*a* are included, can be inserted into a mold 9. The shape of the immersion nozzle 4 is not restricted to that shown in FIG. 1. For instance, it is possible to employ an immersion nozzle which has more than two exit ports 4*a*, or steps of different inside diameters on its inner surface in the axial direction, or a flow adjusting plate aligned in the axial direction on its inner surface, or helical projections on its inner surface, or a dual structure providing inner nozzle at its upper part.

The one electrode 5 is disposed in such a manner that it pirces the sidewall of the tundish 1 and its one end reaches the inner space of the tundish 1. When the molten steel 8 is supplied into the tundish 1, an end of the one electrode 5 is preferably immersed into the molten steel 8 in the state of operation. In this case, it is preferable that the surface area of the one electrode 5, which comes in contact with the molten steel 8, should be not less than 10 $cm^2$.

It is required that the material forming the one electrode 5 has a good electrical conductivity and a long time durability in the state in which it is in contact with the molten steel 8 in the tundish 1. Accordingly, the material can be selected from refractory materials, graphite, steel, high melting-point metal, such as molybdenum, tungsten or the like, or a composite material thereof.

The installation of the one electrode 5 can be carried out according to one of the following methods, as shown in FIG. 1. In a method, a bore for the electrode is formed in iron shells of the sidewall of the tundish and a refractory material thereof, and then the electrode is inserted into the iron shell and the refractory material. In another method, the one electrode 5 is immersed into the molten steel 8 by inserting it directly from the top surface of the molten steel. When, moreover, a stopper is employed as a flow control mechanism for pouring the molten steel into the mold, the stopper is constituted by a refractory material having a good electrical conductivity and then the stopper itself can be used as one electrode 5.

Alternatively, the upper nozzle or the sliding gate constituted by a refractory material having a good electrical conductivity can be used as one electrode 5. Each of these electrodes may provide a similar effect, so that the selection of one electrode can be carried out from viewpoint of the manufacturing cost and the ease in operation. If, however, the one electrode 5 is disposed in the mold, an electrical current occasionally flows via the outer surface of the immersion nozzle, thereby making it difficult to prevent the Al oxide or the like in the molten steel to be deposited onto the inner surface of the immersion nozzle. Accordingly, the one electrode 5 should not be disposed in the mold.

Since the other electrode 6 is not in direct contact with the molten steel 8, a metal having the heat-resisting property up to approx. 1,200° C., or a material, such as $TiB_2$, $ZrB_2$, SiC, graphite or the like, can be used as a refractory material for the other electrode 6. A metal, such as carbon steel, stainless steel, Ni or the like, has a better electrical conductivity, compared with the above refractory materials. However, it tends to react with carbon included in the immersion nozzle, and then it occasionally changes into a low melting-point material, hence arising a problem of material dissipation due to dissolving. Therefore, the electrode constituted by the refractory material is preferably employed when a heavy thermal charge will be applied thereto.

The other electrode 6 has to be in contact with a part of an element constituted by a refractory material having a good electrical conductivity. The other electrode 6 shown in FIG. 1 has a cylindrical shape and embedded in the refractory material of the immersion nozzle 4, and is interposed between the upper end of the immersion nozzle 4 and a level slightly above the meniscus level in the mold 9. It is preferable that the other electrode 6 is disposed facing the whole inner surface of the immersion nozzle 4. However, if the other electrode 6 is disposed being below the meniscus level of the immersion nozzle 4, there is a possible danger that the material of the other electrode 6 melt according to the selected material. Hence, such an arrangement as shown in FIG. 1 is normally employed.

When the cylindrical shape and the above-mentioned arrangement are employed for the other electrode 6, the other electrode 6 approaches the molten steel 8 passing through the inner surface of the immersion nozzle 4 over almost the entire area of the immersion nozzle 4 with the substantially same distance therebetween in continuous casting. This structural arrangement enables to suppress the spatially partial drop of voltage, when the electrical current passes through the refractory material forming the immersion nozzle 4.

In accordance with the present invention, the shape and arrangement of the other electrode 6 is not restricted to those shown in FIG. 1. The shape and arrangement shown in FIGS. 2 to 4 can also be employed. In conjunction with this fact, the same refractory material as that for the one electrode 5 can be used for the material of the other electrode 6.

Figure 2:
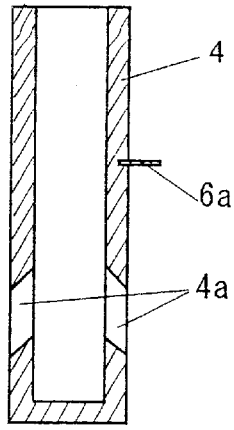
FIG. 2 is a longitudinal sectional view of another embodiment of an immersion nozzle, the other electrode being embedded in the immersion nozzle.

FIG. 2 is a longitudinal sectional view of another embodiment, in which case, the other electrode 6 is embedded in the immersion nozzle 4. In FIG. 2, the other electrode 6*a* is a rod-shaped piece made of a conductive refractory material and is embedded in a small area of the immersion nozzle 4 from the outer surface thereof. The embedding can be realized by machining a hole in the immersion nozzle 4, either when or after it is produced by means of the press-sintering method.

So long as a material having a greater electrical conductivity is used as the refractory material, which becomes in contact with the molten steel, the electrode having such a simple structure provides no local electrical current and can be effectively operated over a wide range. As for the shape of the electrode 6*a*, it is desirable that an end part thereof is parallel to the axis of the immersion nozzle 4 and can be embedded in the immersion nozzle 4.

Figure 3:
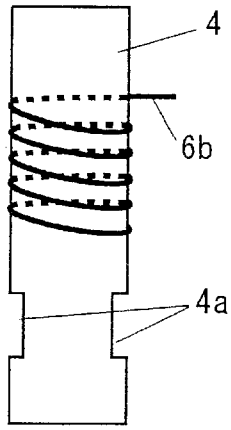
FIG. 3 is a plan view of another embodiment of an immersion nozzle, the other electrode being mounted to the outer surface of the immersion nozzle.

FIG. 3 is a plan view of another embodiment of an immersion nozzle, wherein the other electrode 6 is mounted onto the outer surface of the nozzle. In FIG. 3, the other electrode 6*b* comprises a wire-shaped or rod-shaped element and is wound around the outer surface of the immersion nozzle 4. Normally, the outer surface of the immersion nozzle 4 is coated by an antioxidant. Since the antioxidant has an electric insulation property, the antioxidant coated has to be removed, when the other electrode 6*b* is wound around the immersion nozzle 4.

Figure 4:
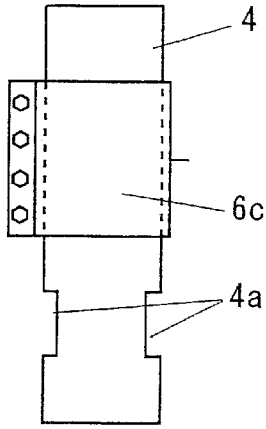
FIG. 4 is a plan view of another embodiment of an immersion nozzle, the other electrode being mounted to the outer surface of the immersion nozzle.

FIG. 4 is also a plan view of another embodiment of an immersion nozzle, wherein the other electrode 6 is mounted on the outer surface of the nozzle. In FIG. 4, the other electrode 6*c* comprises an annular metal element, which is equipped with clamp means at an opened part thereof. The clamp means is fastened by means of bolts and nuts after the other electrode 6*c* is mounted on the outer surface of the immersion nozzle 4. In this case, the antioxidant coated on the outer surface of the immersion nozzle 4 is also removed.

The power supply 7 is connected with one electrode 5 and the other electrode 6 of the paired electrodes via lead wires 7*a*, and a power is supplied to the electrodes 5 and 6 in the case of operation.

In the apparatus for supplying molten steel shown in FIG. 1, the immersion nozzle 4 is constituted by a refractory material having a good electrical conductivity, and the upper nozzle 2 and sliding gate 3, whose inner surfaces are in contact with the molten steel, can be constituted by a refractory material having a good electrical conductivity. However, regarding the element onto which the other electrode 6 is mounted, i.e., regarding the immersion nozzle 4 in FIG. 1, the inner surface, with which the molten steel comes in contact, has to be formed by the refractory material having a good electrical conductivity.

In the apparatus for supplying molten steel shown in FIG. 1, the other electrode 6 is mounted onto the immersion nozzle 4. This is due to the fact that Al oxide or the like is deposited most frequently on the inner surface of the immersion nozzle 4 during the continuous casting, and thus a current should be supplied between the molten steel passing through the immersion nozzle 4 and the inner surface of the immersion nozzle 4.

When the immersion nozzle 4 is constituted by the refractory material having a good electrical conductivity, the whole parts of the immersion nozzle 4 can be formed by a refractory material having a good electrical conductivity. Furthermore, the immersion nozzle 4 can be formed by employing more than double radial layers structure wherein the outer layer is constituted by a material having a high mechanical strength and the inner layer being in contact with the molten steel is constituted by a refractory material having a good electrical conductivity. Moreover, a part of the inner layer or the outer layer can be constituted by a material such as high purity alumina or the like having a less electrical conductivity.

On the other hand, when the Al oxide or the like is apt to deposit onto the sliding gate 3, the sliding gate 3 can be constituted by a refractory material having a good electrical conductivity and then the other electrode 6 can be mounted onto the sliding gate 3. In addition, more than two of the upper nozzle 2, the sliding gate 3 and the immersion nozzle 4 can also be constituted by refractory materials and then the other electrode 6 can be mounted onto each of them.

When the sliding gate 3 is constituted by a refractory material having a good electrical conductivity, it is preferable that the movable plate 33 which has the narrowest flow channel and to which Al oxide or the like tents to deposit is constituted by the refractory material having a good electrical conductivity. In this case, the sliding gate 3 can also be constituted, as similar to the upper nozzle 2, by more than double radial layers structure, and the inner layer in contact with the molten steel is constituted by the refractory material having a good electrical conductivity.

When one of the upper nozzle 2, the sliding gate 3 and the immersion nozzle 4 is constituted by a refractory material and the other electrode 6 is mounted on it, it is preferable that the other electrode 6 is mounted onto the immersion nozzle 4. Such a structural arrangement is employed to supply an electrical current between the inner surface of the immersion nozzle 4 and the molten steel during the continuous casting, since Al oxide or the like deposited on the inner surface of the immersion nozzle 4 influences upon the stability of operation in the continuous casting and the quality of products.

Moreover, when the other electrodes 6 are mounted onto several elements, it is necessary to provide no great difference between the resistances of the each circuit. This is due to the fact that a great difference causes an electrical current to flow in only a specific channel and no electrical current to flow in the other channels, thereby making it impossible to prevent the clogging in the other channels.

2. Refractory Material Having a Good Electrical Conductivity

As for the refractory material having a good electrical conductivity, it is preferable that the material has an electrical conductivity of not less than $1\times10^2$ S/m, and more preferably, $1\times10^4$ to $1\times10^6$ S/m at a temperature not less than the melting point of the molten steel 8 stored in the tundish. Generally, the refractory material having a good electrical conductivity can be selected from materials including graphite such as alumina graphite, zirconia graphite, magnesia graphite or the like as a main component, materials of solid electrolyte, materials of boride system, such as $TiB_2$, $ZrB_2$ or the like. In the following, the properties of the respective materials will be described:

Refractory matter of alumina graphite

It is preferable that the refractory material of alumina graphite, which is frequently used in the immersion nozzle, contains 5 to 35 wt % graphite. Not less than 5 wt % graphite provides a good electrical conductivity over a wide range from the room temperature to a temperature at which the steel is molten. More preferably, not less than about 12 wt % graphite provides an electrical conductivity of not less than $1\times10^4$ S/m.

However, more than 35 wt % graphite deteriorates the mechanical strength of the refractory and the corrosion resistance against the molten steel, so that there arises a problem of erosion. Even if the refractory material of alumina graphite contains $SiO_2$ in a concentration of 20 wt % or so, there arises no problem in the current supply thereto. $SiO_2$ usually has an advantage of reducing the thermal expansion coefficient of the refractory material of alumina graphite and preventing the damage due to a thermal shock. In conjunction with the above, SiC can be used, instead of $SiO_2$.

Refractory material of zirconia graphite

In the case of the refractory material of zirconia graphite, it is preferable that the graphite is included in a 5 to 20 wt % concentration. The graphite at a concentration of not less than 5 wt % provides a good electrical conductivity over a wide range from room temperature to the temperature at which the steel is molten. More preferably, more than about 10 wt % graphite provides an electrical conductivity of not less than $1\times10^4$ S/m. However, the graphite concentration of more than 20 wt % provides a problem in which the mechanical strength is reduced. It is noted that the upper limit of the graphite concentration in the refractory material of zirconia graphite is smaller than that in the refractory material of alumina graphite. This is due to the fact that the density of zirconia is greater than that of alumina, thereby providing a greater change in the density of the refractory material itself, in which the graphite having a smaller density is included.

Refractory material of solid electrolyte

This is the refractory material of solid electrolyte, for instance, zirconia solid electrolyte in which graphite is not included. Such a solid electrolyte has a good electrical conductivity at a temperature at which a steel is molten. However, the electrical conductivity is approximately $1\times10^2$ S/m at the melting point of the steel and therefore it is not sufficiently large. The usage of such a material provides a problem in which an electrical current flows in a short circuit and local partial currents arise, thereby making it difficult to prevent the alumina or the like to be deposited thereon over a wide area.

In order to overcome such a problem, it is necessary to embed the other electrode 6 having a cylindrical shape in the immersion nozzle 4, as shown in FIG. 1, in order to pass through the same current density over a wide spatial area. From this viewpoint, the refractory material having an electrical conductivity of not less than $1\times10^3$ S/m should be used in the present invention. Moreover, it is difficult to apply the solid electrolyte to the process of flowing the molten steel after preheated, as performed in the continuous casting of the molten steel, since the solid electrolyte has less property regarding to the proof against a thermal shock. It is further noted that the usage of such a material provides an increase in the cost of manufacturing the refractory material.

Refractory material of boride system

For instance, $TiB_2$ or $ZrB_2$, has an electrical conductivity of not less than $1\times10^5$ S/m, so that it can be employed as a refractory material for supplying a current to the steel.

As described above, either the refractory material including graphite as a main component or the refractory material of boride system can be employed. However, such a refractory material of boride system is expensive to manufacture, so that it is difficult to construct a large structure with the refractory material. As a result, the refractory material of boride system can be exclusively used in only a part of a channel for flowing the molten steel.

In summary, the refractory material, which is preferably used in the present invention, is the refractory material including graphite as a main component. When the heat-resisting property, mechanical strength, erosion resistance and the manufacturing cost are totally taken into consideration, it is preferable that the refractory material of alumina graphite should be used.

3. Implementation of Insulation

In the apparatus for supplying molten steel according to the present invention, it is preferable that an insulating element is interposed between one electrode 5 and an element on which the other electrode 6 is mounted, said element being one of the upper nozzle 2, the sliding gate 3 and the immersion nozzle 4, which are formed by a refractory material having a good electrical conductivity.

In the apparatus for supplying molten steel shown in FIG. 1, one electrode 5 is disposed in the tundish 1 and the other electrode 6 is disposed in the immersion nozzle 4. In this case, it is preferable that the insulating element is interposed either between the tundish 1 and the one electrode 5, or between the tundish 1 and the upper nozzle 2, or between the upper nozzle 2 and the sliding gate 3, or between the sliding gate 3 and the immersion nozzle 4.

This treatment makes it possible to suppress the formation of short circuits between the one electrode 5 and the immersion nozzle 4 in which the other electrode 6 is disposed, when an electrical current is supplied. In this case, if another insulating element is further interposed between the immersion nozzle 4 in which the other electrode 6 is disposed and the sliding gate 3 adjacent thereto, the leak current to the sliding gate 3 can be further suppressed, thereby enabling the current to effectively be supplied to the molten steel.

Regarding the degree of insulation in this case, the initial electrical resistance between the one electrode 5 and the other electrode 6 in the tundish is set to be more than 500Ω, either at the time at which the preheating of the tundish is ended before the molten steel is supplied to the tundish, or at the time before the molten steel is supplied to the tundish when the tundish which is once used for the casting is recycled without preheating. If the initial electrical resistance is less than 500Ω, no sufficient current sends into the molten steel passing through the inside of the immersion nozzle 4 during the casting and the current flows in a short circuit to elements other than the molten steel, thereby making it impossible to effectively prevent the deposition of the Al oxide or the like onto the inner surface of the immersion nozzle.

In an aspect of the insulation implementation, it will be useful to interpose a refractory material having a low electrical conductivity, either between the tundish 1 and the one electrode 5, or between the upper nozzle 2 and the refractory material of the tundish 1 and/or the steel structure of the tundish, or between the sliding gate 3 and the steel structure of the tundish 1. Moreover, an insulating sheet comprising glass fibers can also be inserted between the above-mentioned elements. It is useful to further interpose an insulating sheet between every two of the upper nozzle 2, the sliding gate 3 and the immersion nozzle 4, and between each of these elements and corresponding supporting element, and between adjacent layers in the case of the double layer structure.

More specifically, in the case in which the other electrode 6 is disposed in the immersion nozzle 4 as a refractory material having a good electrical conductivity, and an electrical current is supplied between the immersion nozzle and the molten steel passing through the inside of the immersion nozzle, it is preferable that either [1] between the tundish 1 and the one electrode 5 or [2] between the immersion nozzle and the gate 3 which is in contact with the immersion nozzle, and between the immersion nozzle and a holder for supporting the immersion nozzle on the sliding gate, or both the above [1] and [2] is/are electrically insulated from each other. In this structural arrangement, the immersion nozzle 4 and the main body of the tundish 1, said main body comprising the refractory material lining and the steel structure, can also be electrically insulated from each other.

Moreover, in the case in which the other electrodes are disposed in the immersion nozzle 4 and the gate 3, which are constituted by a refractory material having a good electrical conductivity, and electrical currents are supplied respectively between the immersion nozzle 4 and the molten steel passing through the inside of the immersion nozzle and between the upper nozzle 2 and the molten steel, it is preferable that either [1] between the tundish 1 and the one electrode 5 or [2] between the gate 3 and the main body of the tundish, between the gate 3 and the upper nozzle, and between the gate 3 and a cassette holder for supporting the gate onto the steel structure of the tundish, or both the above [1] and [2] is/are electrically insulated from each other.

Furthermore, in the case in which the one electrodes are disposed in the immersion nozzle 4, the gate 3 and the upper nozzle 2, which are constituted by a refractory material having a good electrical conductivity, and an electrical current is supplied respectively between the molten steel passing through the inside of the immersion nozzle and the immersion nozzle 4, between the molten steel and the gate 3, and between the upper nozzle 2 and the molten steel, it is preferable that either [1] between the tundish 1 and the one electrode 5 or [2] between the steel structure of the tundish and each of the immersion nozzle, the gate and the upper nozzle, or both the above [1] and [2] is/are electrically insulated from each other.

The mineral material used for insulation generally has an electrical resistance of not less than $1\times10^5$ Ω·m at room temperature, thereby providing a sufficient insulating property. However, the ion conductivity takes place in most mineral materials at such a high temperature as those in the molten steel, so that the electrical resistance decreases. Hence, as a refractory material exhibiting a very small amount of reduction in the electrical resistance even at such a high temperature as that in the molten steel, for example, either an insulating sheet comprising fibers of such an insulating refractory material, such as $Al_2O_3$, $SiO_2$ or the like, or a coating material including $Al_2O_3$, $SiO_2$ or the like can be employed.

In an actual usage of such an insulating sheet and/or coating material, the insulating sheet is inserted and then clamped either between the immersion nozzle and the gate in contact therewith or between the immersion nozzle and the holder for supporting the immersion nozzle on the sliding gate, the holder being in contact with the immersion nozzle, to form a sandwich structure. In this case, the thickness of the sheet is preferably 1 to 4 mm. Moreover, it is more preferable to deposit the coating material on the insulating portions together with an adhesive. In this case, the thickness of the coating is preferably 0.2 to 1.0 mm, and alumina matter, silica matter or the like can be used for the adhesive.

The upper limit of the initial electrical resistance is ideally infinite. However, it tends to be $1\times10^8$ Ω in an apparatus for supplying the molten steel from a tundish to a mold in actual continuous casting machine.

In the continuous casting method according to the present invention, it is preferable that the electrical resistance which is calculated from the current and voltage between the one electrode 5 and the other electrode 6 during the period from the start to the end of casting is less than 1/10 of the initial electrical resistance between the one electrode and the other electrode in the tundish, either at the end of preheating of the tundish before the molten steel is supplied, or at the time before the molten steel is supplied to the tundish in the case in which the tundish is recycled without preheating. In the following, the reason for the above matter will be described.

Figure 5:
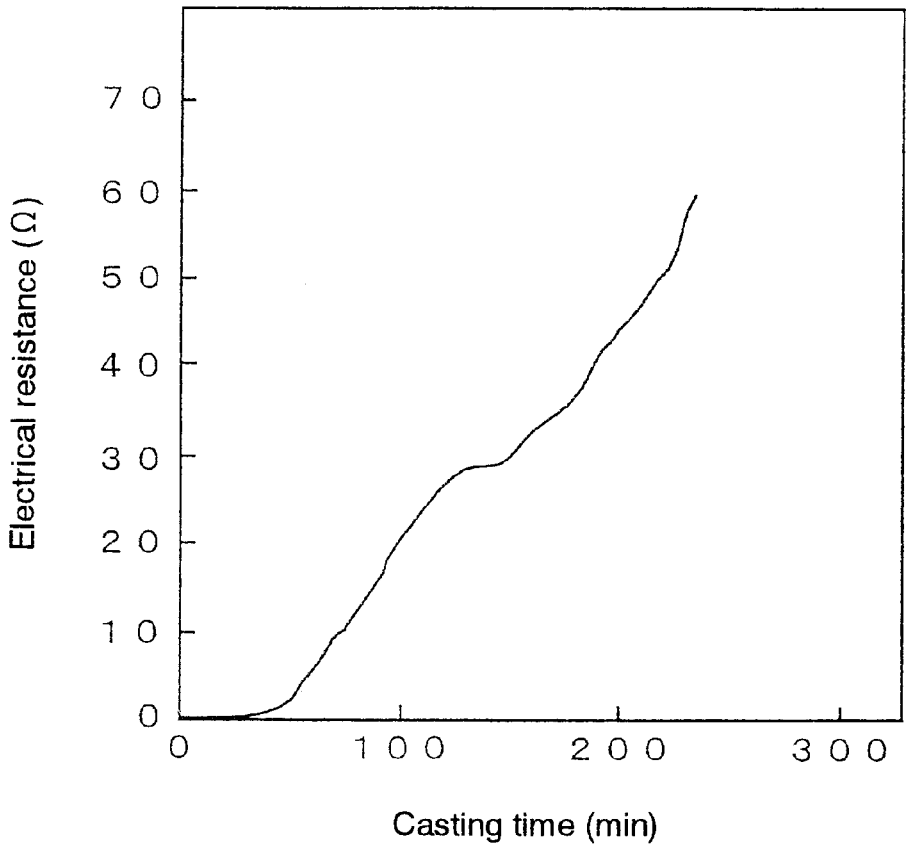
FIG. 5 is a diagram showing the change of the electrical resistance between one electrode and the other electrode during the casting.

FIG. 5 is a diagram showing the change in the electrical resistance between one electrode and the other electrode during the casting. In the diagram, the change is exemplified in the case of the initial electrical resistance of 0.7Ω. Although the resistance exhibits little change during a period of casting, i.e., a certain period of current supplying, the resistance of the circuit, in which an electrical current flows in the molten steel passing through the inside of the immersion nozzle, normally increases. This is assumed due to the fact that the surface of the refractory material which has a good electrical conductivity and disposed in the immersion nozzle, said surface being in contact with the molten steel, changes in quality as time passed and/or non-conductive materials, such as alumina or the like, are deposited on the surface.

When during casting the electrical resistance becomes to be not less than 1/10 of the initial electrical resistance, the current cannot properly flow in the molten steel passing through the inside of the immersion nozzle, and partial currents flow in short circuits of materials other than the molten steel, thereby making it impossible to prevent the Al oxide or the like from being deposited onto the inner surface of the immersion nozzle. When, moreover, the electrical resistance in the casting increases up to an amount of greater than 1/10 of the initial electrical resistance, not only waste of the applied electric power takes place, but also a danger of small discharges due to the current leakage to the exterior occurs because the partial currents flow in short circuits of the materials other than the molten steel. In this case, such troubles as receiving an electric shock and/or causing malfunction of surrounding instruments occur.

Figure 6:
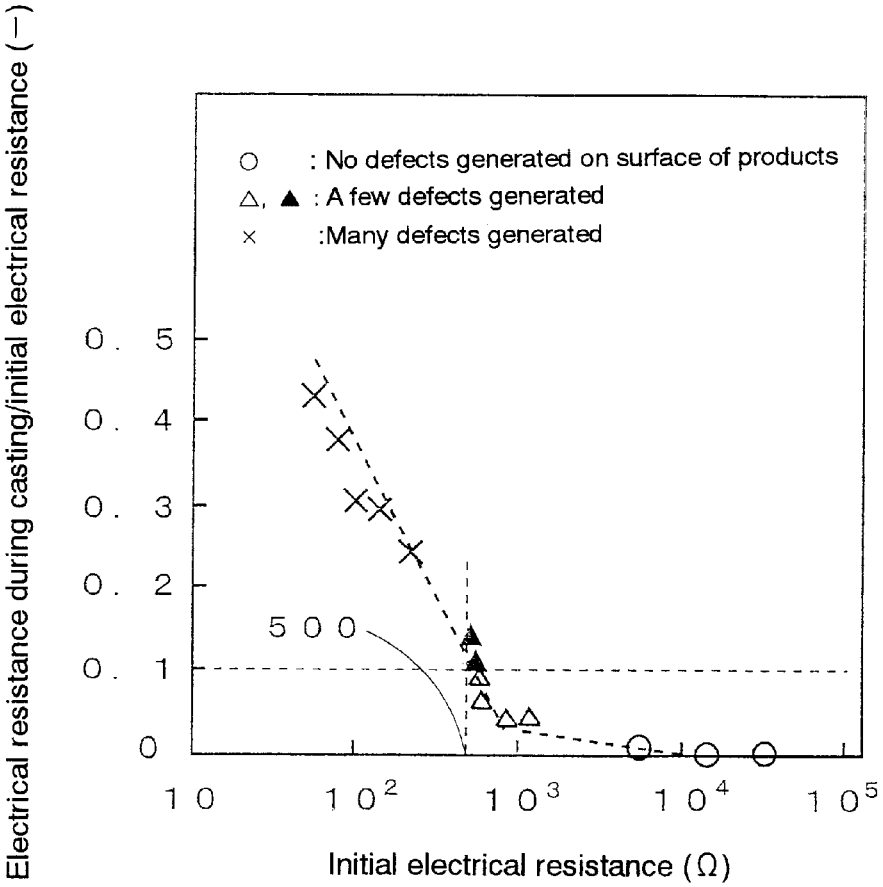
FIG. 6 is a diagram showing the influence of the electrical resistance between one electrode and the other electrode upon the surface defects of the cold-rolled products.

FIG. 6 is a diagram showing the influence of the electrical resistance between one electrode and the other electrode upon the surface defects of a cold-rolled product. The transverse axis indicates the initial electrical resistance between one electrode and the other electrode just before the start of the casting, and the longitudinal axis indicates the ratio of the electrical resistance during the casting to the initial electrical resistance where the former resistance is calculated by the current and voltage between the one electrode and the other electrode at the last stage of the casting.

An slab was hot-rolled to form a steel strip having a 5 mm thickness. Thereafter, the steel strip was pickled and finally cold-rolled to form a steel strip having a 0.8 mm thickness. An inspection was made as to whether or not surface defects of the products exist and as to the state of the surface defects generated. The rate of generating the surface defects in a product was determined in the percentage expression by the ratio of the total accumulated length of parts to the length of the initial steel strip, wherein the parts included surface defects and therefore were removed from the original steel strip in which case, the surface defects resulted from the defects such as mold powder, Al oxide or the like in the slab. In the diagram, mark ○ indicates a value for the products which include no surface defects resulting from the defect such as mold powder, Al oxide or the like on the slab surface.

In FIG. 6, mark Δ indicates a value for the products, which include a few surface defects within the above-mentioned rate of generating the defects being 0.5%, and mark ▲ indicates a value for the products, which include the surface defects within the above-mentioned rate of generating the defects being 1.0%. It is noted that there are no serious problems in the case of the defects being included within the rate of generating the defects of 1.0%. In the drawing, moreover, mark X indicates a value for products have the surface defects with the rate of generating the defects of more than 5%. The drawing shows the experimental results obtained for the various initial electrical resistances by changing the implementation of the electrical insulation.

From the results in FIG. 6, it can be recognized that the initial electrical resistance of not less than 500Ω may suppress the generation of the surface defects of the products. Moreover, if the electrical resistance which is determined from the current and voltage between the one electrode and the other electrode in the last stage of casting is less than 1/10 of the initial electrical resistance, products having a better surface quality can be obtained. Although the lower limit for the ratio of the electrical resistance during the casting to the initial electrical resistance should be ideally zero, it tends to be 0.00001/10 in an actual apparatus for supplying the molten steel from the tundish into the mold.

4. Purging of Gas

A gas purging part constituted by a porous refractory material (not shown) can be disposed in one or more than one of the upper nozzle 2, the sliding gate 3 and the immersion nozzle 4. The gas purging part can be used as follows:

When the molten steel includes much Al oxide or the like in accordance with the operation state of a converter, an RH or the like, an inert gas is purged into the immersion nozzle 4 in order to prevent the Al oxide deposition onto the inner surface thereof. Moreover, in order to avoid the trouble in the passage of the immersion nozzle resulting from the solidification of the molten steel at the start of casting operation, or in order to improve the molten steel stream in the mold, such an inert gas is also purged thereinto.

In this case, it is preferable that the other electrode(s) 6 can be disposed in one or two of the upper nozzle 2, the sliding gate 3 and the immersion nozzle 4, or more preferably in the immersion nozzle 4, and the gas purging part(s) can be disposed in one or two of the elements in which the other electrode(s) 6 is/are not disposed. In this structural arrangement, both the other electrode 6 and the gas purging part are not disposed in one element, thereby making it possible to prevent a reduction in the mechanical strength of the refractory materials.

In the apparatus for supplying molten steel shown in FIG. 1, the one electrode 5 is disposed in such a manner that an end thereof passes through the sidewall of the tundish 1 and reaches the inner space of the tundish 1. However, the one electrode 5 can be disposed in such a manner that the end thereof does not pass through the sidewall of the tundish 1, but reaches the inner space of the tundish 1 from the above part thereof. Otherwise, a part of the sidewall of the tundish 1 is formed by a refractory material having a good electrical conductivity, and this part can be used as the one electrode 5.

In another embodiment, the upper nozzle 2 or the sliding gate 3 is constituted by a refractory material having a good electrical conductivity, and the one electrode 5 can be disposed in the upper nozzle 2 or the sliding gate 3. When the one electrode 5 is disposed in the upper nozzle 2, one or both of the sliding gate 3 and the immersion nozzle 4 are constituted by a refractory material having a good electrical conductivity, and the other electrode 6 is disposed in one or both of these elements.

When one electrode 5 is disposed in the sliding gate 3, one or both of the upper nozzle 2 and the immersion nozzle 4 are constituted by a refractory material having a good electrical conductivity, and the other electrode 6 is disposed in one or both of these elements. In these cases, an insulating element is interposed between the element including the one electrode 5 and the element including the other electrode 6. Moreover, an insulating element can be interposed between the upper nozzle 2 and the tundish 1 in order to prevent the electrical current from flowing into the tundish 1.

5. Application of the Current and Voltage

In the method for carrying out the continuous casting, employing the apparatus for supplying molten steel shown in FIG. 1, the apparatus for supplying molten steel is disposed above the mold 9, and the molten steel 8 in the tundish 1 is supplied into the mold 9 via the upper nozzle 2, the sliding gate 3 and the immersion nozzle 4.

In this operation mode, the power supply 7 is turned on. The one electrode 5 and the other electrode 6 are connected to the power supply 7 via lead wires 7*a*. In this case, the one electrode 5 is immersed in the molten steel stored in the tundish 1 and the other electrode 6 is disposed in the immersion nozzle 4 constituted by the refractory material having a good electrical conductivity, thereby enabling the electrical current to be supplied between the inner surface of the immersion nozzle 4 and the molten steel passing through the inside of the immersion nozzle 4.

Either an AC or DC current can be employed for the current supply. In the case of the DC current, either positive or negative potential can be applied to the immersion nozzle, and either a pulse-like or rectangular waveform is allowed to apply the current. Furthermore, the current can be supplied either continuously or intermittently.

When the electrical current is supplied between the inner surface of the immersion nozzle 4 and the molten steel passing through the inside of the immersion nozzle 4 in such a manner as described, the interfacial tension between the inner surface of the immersion nozzle 4 and the molten steel decreases due to the above-mentioned electrical capillarity. For this reason, the adhesive force of the Al oxide or the like in the molten steel to the surface of the refractory material decreases, thereby making it difficult to adhere the Al oxide or the like on the inner surface of the immersion nozzle 4.

During the current supply, it is preferable that the current density on the surface of the conductive part made of the refractory material having a good electrical conductivity can be maintained to be 0.001 to 0.3 amperes/$cm^2$ ($A/cm^2$). However, at a current density of more than 0.3 $A/cm^2$, the effect is saturated and the refractory material is heated by means of its resistance. When it is necessary to flow an electrical current having a high current density over a wide area, the apparatus such as the power supply 7, the lead wires and etc. becomes on a large scale, and therefore it is necessary to supply a greater amount of electrical power. On the other hand, the effect of preventing the deposition cannot be obtained at a current density of less than 0.001 $A/cm^2$, and a more preferable condition of operation can be obtained at a current density of 0.01 to 0.1 $A/cm^2$.

The voltage applied between the other electrode 6 and the one electrode 5 can be determined in accordance with the above-mentioned current density, the electrical resistance of the refractory material and the electrical resistance of the material deposited on the inner surface of the refractory material, and it can be set preferably at 0.5 to 100 volts (V). At an applied voltage of less than 0.5 V, the effective current cannot flow due to the resistance in the current channel, thereby making it difficult to detect the applied current and voltage. At the upper limit of the applied voltage, i.e., 100 V, a required current may be obtained if the resistance for the current channel can properly be preset. At an applied voltage of more than 100 V, a danger of receiving an electric shock takes place and the degree of danger abruptly increases with the increase of the applied voltage. From these facts, it follows that the more preferable voltage to be applied ranges from 1 to 60 V.

Figure 7:
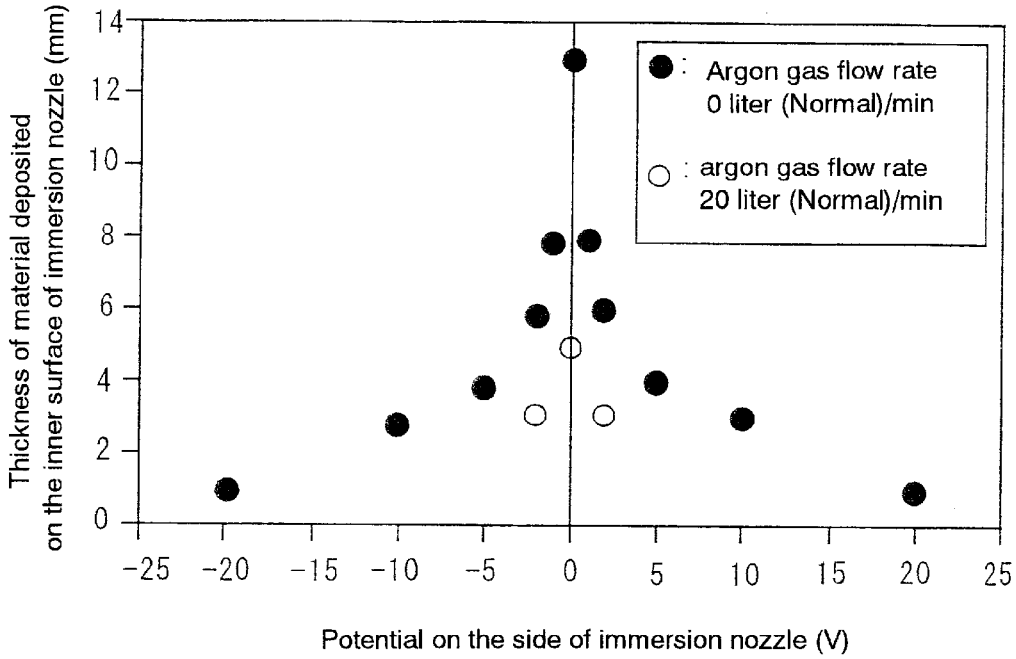
FIG. 7 is a diagram showing the relationship between the thickness of a layer of Al oxide or the like deposited on the inner surface of an immersion nozzle and a voltage applied between one electrode and the other electrode.

FIG. 7 is a diagram showing the relationship between the thickness of the deposited material, such as Al oxide or the like on the inner surface of the immersion nozzle 4, and the voltage applied between the one electrode 5 and the other electrode 6, in which case the immersion nozzle 4 was constituted by a refractory material having a good electrical conductivity and the other electrode 6 was embedded in the immersion nozzle 4, and then the continuous casting was carried out under the same conditions as those in the example 1 which will be later described. In FIG. 7, the same structural arrangement is used regarding both the channel of supplying the current and the contact area of the refractory material with the molten steel, and the current and the current density increase with the voltage.

As can be seen from the diagram, in the case of flowing no argon (mark ● in the diagram), the thickness of the deposited material is 13 mm or so at a potential of 0 (zero), and it decreases to be 8 mm or so, when the potential is set to be +1 V or −1 V. Moreover, when the potential is set to be +5 V or −5 V, the thickness of the deposited material further decreases to be about 4 mm. The thickness of the deposited material is smaller by 5 mm than those obtained at a potential of 0 in the case of flowing argon at a flow rate of 20 liters (Nl)/min (mark ○). When the potential is set to be +20 V or −20 V, the thickness of the deposited material further decreases to be 1 mm or so. Although no clear difference can be found in the diagram, it can be discerned that the thickness of the material deposited on the inner surface of the immersion nozzle 4 tends to be smaller at a negative (−) potential applied to the immersion nozzle 4, compared with that at a positive (+) potential.

6. The Negative Potential on the Side of the Immersion Nozzle

When an electrical current is supplied between the immersion nozzle 4 and the molten steel, and not a positive potential but a negative potential is applied to the immersion nozzle 4, then the thickness of the material deposited on the inner surface of the immersion nozzle 4 tends to decreases. This is due to the following facts:

Under the condition of current supply, the electronic conduction in carbon plays an essential role in the refractory material, e.g., alumina graphite, including carbon. However, in an oxide, the polarization takes place. The above-mentioned change in the interfacial tension results from the polarization, and the reactions expressed by the following equations (a) to (c) take place in the oxide composed of the refractory material:

$$Si^{4+}+4e^{-}=Si \quad (a)$$

$$Al^{3+}+3e^{-}=Al \quad (b)$$

$$O^{2-}=O+2e^{-} \quad (c)$$

When a negative potential is applied to the refractory material having a good electrical conductivity, the reactions of equations (a) and (b) progress in the right direction, but no reaction of equation (c) takes place. As a result, no oxygen as a source for generating the alumina is produced, thereby enabling the deposition on the inner surface of the nozzle to be prevented.

When a negative potential is applied to the refractory material having a good electrical conductivity and a DC current is supplied between the refractory material and the molten steel, the interfacial tension is reduced and further the reaction expressed by the above equation (c) is suppressed, thereby enabling the deposition of the Al oxide or the like in the molten steel onto the surface of the refractory material to be suppressed.

When a positive potential is applied to the refractory material and a DC current is supplied thereto, the reaction expressed by the above equation (c) takes place, even if the interfacial tension is reduced. Hence, the effect of preventing the Al oxide or the like from being deposited on the surface of the refractory material becomes weak. When an AC current is supplied between the conductive refractory material and the molten steel, the promotion and suppression of the reaction expressed by equation (c) alternately take place, so that the effect of preventing the Al oxide or the like in the molten steel from being deposited on the surface of the refractory material is weak. As a result, it is preferable that a negative (−) potential is applied to the immersion nozzle and then a DC current is supplied thereto.

As described above, the electrical current is supplied between the inner surface of the immersion nozzle 2 and the molten steel 8 passing through the inside thereof, and under this condition, the molten steel 8 in the tundish 1 is supplied into the mold 9. Moreover, in order to provide the heat insulation and to suppress the oxidation, as well as in order to obtain the lubrication of the solidified shell 10 relative to the mold 9, mold powder 11 is poured on the meniscus of the molten steel in the mold 9. The molten steel 8 supplied into the mold 9 solidified as shell 10 on the surface of the mold 9, and then withdrawn by means of a withdrawing apparatus (not shown) to form the slab.

When the molten steel 8 passes through the inside of the immersion nozzle 4, an electrical current is supplied between the molten steel 8 and the inner surface of the immersion nozzle 4 and thereby a potential difference arises therebetween, so that the Al oxide or the like cannot be deposited on the inner surface of the immersion nozzle 4. Since, moreover, an inert gas, such as argon gas, is not purged into the molten steel, no defects due to the gas bubbles are generated in the slab.

In the continuous casting method according to the present invention, it is preferable that the molten steel-supplying member having the gas purging part in the upper nozzle 2 is used, and an inert gas is purged into the molten steel passing through the upper nozzle 2 in such a manner that no surface defects due to the gas bubbles entering from the upper nozzle generate on the slab surface. In the course of the inert gas going upward in the molten steel, the oxide particles in the molten steel rise together with the gas bubbles to the surface of the molten steel, and are captured by the molten mold flux on the meniscus of the molten steel, thereby enabling the particles to be removed from the molten steel. As a result, the cleanliness of the slab is enhanced and therefore clean products can be obtained. In this case, it is preferable that the flow rate of the inert gas to be purged should be set to be 2 to 10 liters (Nl)/min in accordance with the size of the slab.

As described above, the apparatus for supplying molten steel according to the present invention is most suitable for using in the method for continuously casting of Al killed steel. However, the apparatus for supplying molten steel according to the present invention is not restricted to the above, and it can also be applied to the continuous casting of a metal including, for instance, zirconium, calcium, rare-earth metal or the like, which induces immersion nozzle clogging or the like, since the deposition of the oxide of these metals on the inner surface of the immersion nozzle can be prevented.

EXAMPLE 1

By utilizing a continuous casting machine of vertical bending type, slabs having a 270 mm thickness and a 1,600 mm width were produced from molten steels A and B which were deoxidized with Al. The chemical composition of the molten steels are given in table 1.

TABLE 1

| Type of steel | Chemical composition of molten steel, residual being Fe and impurities (unit: weight %) | | | | | | |
|---|---|---|---|---|---|---|---|
| | C | Si | Mn | P | S | Al | Ti |
| A | 0.04–0.06 | 0.03–0.04 | 0.16–0.23 | 0.010–0.025 | 0.008–0.012 | 0.03–0.05 | — |
| B | 0.001–0.003 | 0.02–0.04 | 0.09–0.18 | 0.008–0.035 | 0.008–0.013 | 0.03–0.05 | 0.01–0.04 |

A continuous casting machine of vertical bending type equipped with an apparatus for supplying molten steel was used wherein said apparatus comprising an upper nozzle, a sliding gate and an immersion nozzle, more than one thereof being constituted by a refractory material having a good electrical conductivity, and the other electrode was embedded in the above element constituted by the refractory material having a good electrical conductivity. In the tests, a gas purging part was disposed in the upper nozzle or the upper plate in the sliding gate, and a gas was purged at a small flow rate of 3 to 5 Nl/min to open the sliding gate in the initial stage of casting. At such a flow rate, no pinholes were generated on the slab surface, and the gas scarcely bubbled up in the molten steel in the mold, so that almost all the amount of the gas do not remain in the molten steel in the mold, and transfer to the molten steel in the tundish. A conventional type upper plate of the sliding gate that has no electrode was used. In several test trials, the upper plate, which was formed by a refractory material having a good electrical conductivity and to which the other electrode was connected, was used. The tundish used was box-shaped and the capacity thereof was about 85 t.

The immersion nozzle having a 90 mm inside diameter and two exit ports directed downward at an inclination angle of 35° was used. The element, in which the other electrode was embedded, was formed by a refractory material having a good electrical conductivity, said material comprising an alumina graphite composed of 22 wt % graphite, 12 wt % $SiO_2$, and the residual being alumina and impurities.

Either a sheet comprising fibers of alumina and silica or a refractory material made of alumina was interposed between an element in which the other electrode was embedded and an element adjacent thereto, and thus these elements are insulated from each other. The one electrode formed by alumina graphite was immersed into the molten steel in the tundish from the upper surface thereof The other electrode made of graphite or steel was positioned in varied locations.

In the continuous casting, 6 heats, 270 t in each, were sequentially casted In this case, the degree of superheat for the molten steel in the tundish was 20 to 30° C. and the casting speed was 1.5 to 1.8 m/min. Either an AC or DC current was supplied between one electrode and the other electrode, in which case the applied potential was 0 to 20 V, and the supplied current was in a range of 0 to 120 A. The current intensity a and the surface area b of the conductive part on the inner surface of the refractory material, said conductive part being coupled to the other electrode and facing the molten steel, were both altered from test to test, and the current density ($A/cm^2$) defined by the following equation (d) was determined:

$$\text{current density } (A/cm^2) = a/b \qquad (d)$$

where a: current value (A), b: the surface area of the conductive part on the inner surface of the refractory material, facing the molten steel, being coupled to the other electrode and ($cm^2$)

In the case of applying the DC current, either a plus or negative potential was applied to the other electrode. In some test trials, no current was supplied between the one electrode and the other electrode. These test conditions are listed in the table 2.

After the above-mentioned continuous casting was completed, the upper nozzle, the sliding gate and the immersion nozzle were individually collected, and then cut in the longitudinal direction in order to determine the thickness of the material deposited on the inner surface thereof. The thickness of the material deposited on the inner surface of those of the upper nozzle, the sliding gate and the immersion nozzle, in that the other electrode(s) was(were) disposed, was determined by the following procedures: The inside diameters of the above-mentioned element at three different longitudinal positions and at two different surrounding positions were measured, and an averaged value of the inside diameters thus measured was determined. The thickness was determined by ½ of the difference between the average value and the initial inside diameter before the casting.

The slab produced was hot-rolled to form a steel strip having a thickness of 4 to 6 mm. The steel strip thus formed was pickled and then further cold-rolled to form a steel strip having a thickness of 0.8 to 1.2 mm. The surface defects were inspected with the naked eye. The parts in which the surface defects were included were cut and the total accumulated length of the cut pieces was determined. Then, the rate of surface defects was determined by dividing the total length by the initial length of the steel strip. The results are also listed in the table 2. From the results in the table 2, the following can be recognized:

In Test No. 1, no potential is applied and an Ar gas was purged at a very small flow rate of 5 Nl/min for opening the sliding gate in the initial stage of casting, so that the thickness of the material deposited on the inner surface of the immersion nozzle was relatively thick, i.e., 31.4 mm and the rate of surface defects was relatively high, i.e., 9.6%. In Test No. 2, no potential was applied and the Ar gas was purged at a relatively large rate of 20 Nl/min, so that the thickness of the material deposited on the inner surface of the immersion nozzle was 5.4 mm, thinner than that in the case of the Test No. 1, and the rate of surface defects was 3.8% and thus relatively low.

In Tests No. 3 to No. 8, a potential of +2 V, +5 V, +20 V, −2 V, −5 V or −20 V was applied to the immersion nozzle in which the other electrode was embedded, and a DC current was supplied thereto. The thickness of the material deposited on the inner surface of the refractory material (immersion nozzle) and the rate of surface defects were both smaller than those in the case of Test No. 1. Especially, at the potential of +5 V, +20 V, −5 V, −20 V, the thickness of the material deposited on the inner surface of the refractory material (immersion nozzle) and the rate of surface defects were both smaller than those in the case of Test No. 2.

In Tests No. 9 and No. 10, a potential of +2 V or −2 V was applied to the immersion nozzle in which the other electrode was embedded, and a DC current was supplied thereto. An argon gas was purged at a flow rate of 5 Nl/min directly into the immersion nozzle. Compared with the Test No. 3 or No. 6 in which the same conditions were employed except the gas purging, i.e., no Ar gas being supplied, the thickness of the material deposited on the inner surface of the refractory material (immersion nozzle) was thin and the rate of surface defects was similar. An erosion took place in the gas purging part. This is due to the fact that the refractory material of the nozzle was dissolved in the slab by supplying the current to the gas purging part and that the Ar gas was introduced into the molten steel in the mold since the Ar gas was purged directly into the immersion nozzle.

In Test No. 11, a potential of 5 V was applied to the immersion nozzle in which the other electrode was disposed, and an AC current was supplied thereto. The thickness of the material deposited on the inner surface of the refractory material (immersion nozzle) and the rate of surface defects were the same as those in Tests No. 4 and No. 7 in which the same potential was applied and the DC was supplied.

TABLE 2

| Test No. | Type of steel | Embedded position of the other electrode (*1) | Applied voltage (V) | Supplied current (A/cm$^2$) | Type of current | Ar gas purging: Current supplying part | Ar gas purging: Upper nozzle (Nl/min) | Thickness of material deposited on inner surface of refractory material (mm) | Surface defect generating rate (%) |
|---|---|---|---|---|---|---|---|---|---|
| 1 | A | — | — | — | — | Without nozzle | 5 | 13.4 (nozzle) | 9.6 |
| 2 | A | — | — | — | — | Without nozzle | 20 | 5.4 (nozzle) | 3.8 |
| 3 | A | A | 2 | 0.017 | DC | No | 5 | 6.2 | 2.3 |
| 4 | A | A | 5 | 0.034 | DC | No | 5 | 4.3 | 1.4 |
| 5 | A | A | 20 | 0.066 | DC | No | 5 | 1.2 | 0.4 |
| 6 | A | A | −2 | 0.017 | DC | No | 5 | 5.7 | 1.6 |
| 7 | A | A | −5 | 0.034 | DC | No | 5 | 3.6 | 0.7 |
| 8 | A | A | −20 | 0.066 | DC | No | 5 | 0.9 | 0.2 |
| 9 | A | A | 2 | 0.017 | DC | Yes | 5 | 5.7 | 1.6 |
| 10 | A | A | −2 | 0.017 | DC | Yes | 5 | 5.7 | 1.6 |
| 11 | A | A | ±5 | 0.034 | AC | No | 5 | 4.1 | 1.1 |
| 12 | A | B | 2 | 0.049 | DC | Yes | 5 | (*2)− | (*2)− |
| 13 | A | B | 2 | 0.049 | DC | No | 5 | 6.2 | 2.2 |
| 14 | A | B | −5 | 0.122 | DC | No | 5 | 5.6 | 1.4 |
| 15 | A | C | −5 | 0.095 | DC | No | 5 | 4.5 | 1.4 |
| 16 | A | A + C | 2 | 0.011 | DC | No | 5 | 5.6 | 2.1 |
| 17 | A | A + C | −5 | 0.027 | DC | No | 5 | 3.8 | 0.6 |
| 18 | B | — | — | — | — | No | 7 | 12.5 | 7.6 |
| 19 | B | A | 12 | 0.055 | DC | No | 7 | 3.2 | 1.9 |
| 20 | B | A | 5 | 0.034 | DC | No | 7 | 2.3 | 1.6 |
| 21 | B | A | 1.2 | 0.006 | DC | No | 7 | 4.8 | 2.8 |
| 22 | B | A | 0.6 | 0.0009 | DC | No | 7 | 10.3 | 7.1 |
| 23 | B | A | −12 | 0.055 | DC | No | 7 | 1.6 | 1.2 |
| 24 | B | A | −5 | 0.034 | DC | No | 7 | 0.4 | 0.7 |

TABLE 2-continued

| Test No. | Type of steel | Embedded position of the other electrode (*1) | Applied voltage (V) | Supplied current ($A/cm^2$) | Type of current | Ar gas purging: Current supplying part | Ar gas purging: Upper nozzle (Nl/min) | Thickness of material deposited on inner surface of refractory material (mm) | Surface defect generating rate (%) |
|---|---|---|---|---|---|---|---|---|---|
| 25 | B | A | −1.2 | 0.006 | DC | No | 7 | 4.2 | 2.5 |
| 26 | B | A | −0.6 | 0.0009 | DC | No | 7 | 9.8 | 6.4 |
| 27 | B | A | ±5 | ±0.034 | AC | No | 7 | 2 | 1.4 |

(*1) the positions A, B and C at which the other electrode is embedded are as follows:
A: immersion nozzle, B: sliding gate, C: upper nozzle
(*2) No data obtained due to the fracture of the sliding gate In Test No. 12, a potential of +2 V was applied to the sliding gate as an Ar gas purging part in which the other electrode was embedded, and a DC current was supplied thereto. In this case, the casting could not be carried out because the sliding gate was consumed due to an erosion. Although, in the case of the Tests No. 9 and No. 10, there were no problems even when the other electrode was embedded in the immersion nozzle, the erosion of the sliding gate caused the interruption of the casting operation.

In Tests No. 13 and No. 14, the other electrode was embedded in the sliding gate in which the Ar gas purging part was not disposed. An potential of +2 V or −5 V was applied to the sliding gate, and a DC current was supplied thereto. The thickness of the material deposited on the inner surface of the refractory material (sliding gate) was relatively thin, but the rate of surface defects was lower than that in the case of the current being supplied to the nozzle.

In Test No. 15, a potential of −5 V was applied to the upper nozzle in which the other electrode was embedded, and a DC current was supplied thereto. The thickness of the material deposited on the inner surface of the refractory material (upper nozzle) was relatively thin, but the rate of surface defects was lower than that in the case of the current being supplied to the nozzle.

In Tests No. 16 and No. 17, a potential of +2 V or −5 V was applied to the upper nozzle and immersion nozzle in which the other electrode was embedded, and a DC current was supplied thereto. The thickness of the material deposited on the inner surface of the refractory material and the rate of surface defects were both small, and therefore this operation condition was desirable.

In Tests No. 18 to No. 27, a similar test was carried out using the steel of the type B (ultra low carbon steel). From the obtained results, it was found that the ultra low carbon steel provided an increase in the amount of the deposited material. In addition, since a high surface quality is normally required for the products of such an ultra low carbon steel, it may be assumed that the rate of surface defects tends to be deteriorated. In Tests No. 22 and No. 26, a current density was reduced down to 0.0009 $A/cm^2$, and a potential of +0.6 V or −0.6 V was applied. In these cases, no remarkable effect on the prevention of the deposition could be discerned and a greater rate of surface defects was found.

In Tests No. 21 and No. 25, a current density of 0.006 $A/cm^2$ was employed, and a certain effect on the prevention of the deposition could be discerned and a greater rate of surface defects was found. In Tests No. 19, No. 20, No. 23 and No. 24, the current density was further increased, and a more desirable effect could be obtained. In Tests No. 23 to No. 26, a negative potential was applied, the comparison of the results in these tests with those in the Tests No. 19 to No. 22, a positive potential was applied, indicates that a relatively desirable effect on the suppression of the deposition could be obtained.

EXAMPLE 2

By utilizing the same method as that in EXAMPLE 1, an slab having a 270 mm thickness and a 1200 to 1600 mm width was cast at the casting rate of 1.4 to 1.7 m/min. In this case, however, the material of the immersion nozzle was alumina graphite which included 31 wt % graphite, 14 wt % $SiO_2$ and residual composed mostly of $Al_2O_3$ and had a good electrical conductivity at a temperature of molten steel. The one electrode made of carbon steel was mounted onto the outer surrounding of the immersion nozzle and the other electrode made of alumina graphite was immersed into the molten steel from the surface thereof in the tundish.

A sheet comprising refractory fibers having $Al_2O_3$ and $SiO_2$ as main components and/or antioxidant including $SiO_2$ as a main component was interposed either between the immersion nozzle and the sliding gate being in contact therewith, or between the immersion nozzle and the holder for supporting the immersion nozzle on the sliding gate in order to insulate the two elements from each other. In this case, the thickness of the sheet and the antioxidant was varied.

Before the test of casting, the tundish, the upper nozzle, the sliding gate and the immersion nozzle was preheated for about 3 hours using an usual combustion gas, and the refractory lining of the tundish was set at a surface temperature of 1,000 to 1,200° C. The initial electrical resistance between the one electrode and the other electrode was measured just before the end of the preheating.

In the test of casting, molten steel having a weight of about 270 t per heat was six times sequentially cast. Either a constant current or a constant voltage was applied between the one electrode and the other electrode for the period from the start to the end of the casting. In this case, the applied current was 10 to 100 A and the applied voltage was 3 to 80 V From the current and voltage, the electrical resistance between the one electrode and the other electrode during the casting was determined.

Moreover, an Ar gas was purged in a flow rate of 2 to 5 liters (Nl)/min into the molten steel passing through the inside of the sliding gate from the porous refractory material disposed in the sliding gate during the casting. It was confirmed in advance that such a flow rate provided no defects on the slab surface due to the gas.

After the end of casting, the immersion nozzle was collected and cut in the longitudinal direction in order to inspect the existence of the material deposited on the inner surface thereof and to measure the thickness of the deposited material. The respective slabs obtained in the second heat and the sixth heat were hot-rolled to form a steel strip having a thickness of 4 to 6 mm and then pickled. Thereafter, the steel strip was further cold-rolled to form a steel strip having a thickness of 1.6 to 1.2 mm. The inspection was then carried out regarding the existence of surface defects and the state of surface defects in the products. At the same time, the rate of surface defects in the product was determined. In this case, the parts, in which defects resulting from the defects in the slab due to the mold powder, Al oxide or the like were generated, were cut and removed from the original steel strip, so that the rate of surface defects was determined in the percentage expression by dividing the total length of the removed parts by the total length of the initial steel strip. The conditions and results of the test are listed in table 3 of the next page.

TABLE 3

| | Test conditions | | | | | | | Test results | | |
|---|---|---|---|---|---|---|---|---|---|---|
| | Method for implementing insulation (*1) | | | | Electrical resistance and the electrical resistance ratio | | | Thickness of material deposited on the inner surface of immersion nozzle (mm) | Rate of surface defects (%) | |
| Test No. | Between immersion nozzle and gate | | Between immersion nozzle and holder | | After preheating tundish (X) | Before the end of 6th heat of casting (Y) | Value (Y)/(X) | | Slab in 2nd heat used as material | Slab in 6th heat used as material |
| 28 | A | 2.5 | B | 0.2 | 600 | 72 | 1.2/10 | 5 | 0.6 | 0.9 |
| 29 | A | 2.5 | B | 0.4 | 600 | 58 | 0.97/10 | 4 | 0.3 | 0.5 |
| 30 | A | 4.0 | A + B | 1.5 | 1,200 | 8 | 0.07/10 | 2 | 0.3 | 0.4 |
| 31 | A | 4.0 | A + B | 1.5 | 1,050 | 0.5 | 0.005/10 | 1 | 0.3 | 0.3 |
| 32 | A(*2) | 5 | A + B | 2.5 | $380 \times 10^3$ | 13 | 0.0003/10 | 1 | 0.1 | 0.2 |
| 33 | A | 2.0 | B | 0.6 | 420 * | 64 | 1.5/10 | 7 | 0.8 | 7.9 |
| 34 | B | 0.7 | B | 0.5 | 30 * | 32 | 10.6/10 | 11 | 8.4 | 12.3 |
| 35 | No implementation | | No implementation | | No measurement | No measurement | — | 13 | 9.8 | 11.8 |

(*1): A; sheet of refractory fiber material, B; coating of antioxidant of $SiO_2$ system, numerical values; thickness of single element or whole element (mm)
(*2): A 3 mm thick alumina plate interposed only for Test No. 32
* indicating the deviation from the conditions specified by the scope of the present invention In Test No. 28, a 2.5 mm thick sheet made of refractory fibers was interposed between the immersion nozzle and the sliding gate, and an antioxidant composed of $SiO_2$ system was inserted in a thickness of 0.2 mm between the immersion nozzle and the holder. The initial electrical resistance between the one electrode and the other electrode just before the end of preheating the tundish was 600Ω. This value resides within the range defined by the scope of the present invention. Moreover, the electrical resistance during the casting just before the end of the sixth heat in the casting was 72Ω. The value obtained by dividing the electrical resistance during the casting by the initial electrical resistance (hereafter this is abbreviated as the resistance ratio) was 1.2/10 and this value was slightly outside the range of the preferable condition. In Test No. 28, the thickness of the material deposited on the immersion nozzle was 5 mm, thereby providing a good result. Furthermore, the rates of surface defects in the products, which were produced by the slabs obtained in the second and sixth heats, were 0.6% and 0.9%, respectively, and thereby relatively good results were obtained.

In Test No. 29, a 2.5 mm-thick sheet made of refractory fibers was interposed between the immersion nozzle and the sliding gate, and an antioxidant composed of $SiO_2$ system was inserted in a thickness of 0.4 mm between the immersion nozzle and the holder. The initial electrical resistance between the one electrode and the other electrode just before the end of preheating the tundish was 600Ω. This value resides within the range defined by the scope of the present invention. Moreover, the electrical resistance during the casting just before the end of the sixth heat in the casting was 58Ω. The resistance ratio during the casting was 0.97/10 and this value was within the range of the preferable condition. In Test No. 29, the thickness of the material deposited on the immersion nozzle was 4 mm, thereby providing a good result. Furthermore, the rates of surface defects in the products, which were produced by the slabs obtained in the second and sixth heats, were 0.3% and 0.5%, respectively, and thereby relatively good results were obtained.

In Test No. 30, a 4.0 mm thick sheet was inserted between the immersion nozzle and the sliding gate. Moreover, a 1.0 mm thick sheet was inserted between the immersion nozzle and the holder, and at the same time an antioxidant was inserted therebetween in a thickness of 0.5 mm. The initial electrical resistance between the one electrode and the other electrode just before the end of the preheating the tundish in the casting was 1,200Ω. This value was within the range specified by the scope of the present invention. The initial electrical resistance was two times greater than that in Test No. 29. This fact may be due to that the thickness between the immersion nozzle and the sliding gate is greater than that in Test No. 29 and the additional sheet was interposed between the immersion nozzle and the holder, together with the antioxidant inserted therebetween. The electrical resistance during the casting just before the end of the sixth heat in the casting was 8Ω, so that the resistance ratio was 0.07/10, thereby residing within the preferable range. In Test No. 30, the thickness of the material deposited on the immersion nozzle was 4 mm, thereby providing a good result. Furthermore, the rates of generating the defects in the products, which were produced by the slabs obtained in the second and sixth heats, were 0.3% and 0.4%, respectively, and thereby relatively good results were obtained.

In Test No. 31, the method for implementing the insulation was the same as that in Test No. 30. The initial electrical resistance between the one electrode and the other electrode just before the end of the preheating the tundish in the casting was 1,050Ω. The electrical resistance during the casting just before the end of the sixth heat in the casting was 0.5Ω and the increase of the resistance during the casting was small. As a result, the resistance ratio was 0.005/10, thereby residing within the range of the preferable conditions. In Test No. 31, the thickness of the material deposited on the immersion nozzle after the casting was 2 mm, thereby providing a good result. Furthermore, the rates of surface defects in the products, which were produced by the slabs obtained in the second and sixth heats, were 0.3%, respectively, and thereby relatively good results were obtained.

In Test No. 32, a 2.0 mm thick sheet and a 3 mm thick alumina plate were inserted between the immersion nozzle and the sliding gate. Moreover, a 1.8 mm thick sheet and a 0.7 mm thick antioxidant film were inserted between the immersion nozzle and the holder. The initial electrical resistance between the one electrode and the other electrode just before the end of preheating the tundish in the casting was $380\times10^3\Omega$. This value was within the range specified by the scope of the present invention. The thickness of the sheet and the coating material was increased so that the initial electrical resistance was greatly increased. The electrical resistance during the casting just before the end of the sixth heat in the casting was 13Ω. Accordingly, the resistance ratio was 0.0003/10, thereby residing within the range of the preferable conditions. In Test No. 32, the thickness of the material deposited on the immersion nozzle after the casting was 1 mm, and this very small value indicates the best result. Furthermore, the rates of surface defects in the products, which were produced by the slabs obtained in the second and sixth heats, were 0.1% and 0.2%, respectively, and thereby good results were obtained.

In Test No. 33, the thickness of the sheet was 2.0 mm and the thickness of the coated film was 0.6 mm. The initial electrical resistance between the one electrode and the other electrode just before the end of the preheating the tundish in the casting was 420Ω. This value was very small and outside of the range specified by the scope of the present invention. The electrical resistance during the casting just before the end of the sixth heat in the casting was 64Ω and therefore the resistance ratio increased to 1.5/10 and was outside of the preferable condition. In Test No. 33, the thickness of the material deposited on the immersion nozzle was 7 mm and relatively thick. Furthermore, the rates of surface defects in the products, which were produced by the slabs obtained in the second and sixth heats, were 0.8% and 7.9%, respectively. In particular, unsatisfactory results were obtained for the sixth heat.

In Test No. 34, without usage of any sheet made of the refractory fibers, 0.7 mm and 0.5 mm films made of antioxidant including the $SiO_2$ system were inserted respectively between the immersion nozzle and the sliding gate and between the immersion nozzle and the holder. The initial electrical resistance between the one electrode and the other electrode just before the end of preheating the tundish in the casting was 30Ω. This value was extremely small and was outside the range specified by the scope of the present invention. The electrical resistance just before the end of the sixth heat in the casting was 32Ω, and therefore the resistance ratio increased to 10.6/10. This value was very large and situated widely outside the preferable conditions. In Test No. 34, the thickness of the material deposited on the immersion nozzle was 11 mm and greatly thick. Furthermore, the rates of surface defects in the products, which were produced by the slabs obtained in the second and sixth heats, were 8.4% and 12.3%, respectively. These values indicate unsatisfactory results.

In Test No. 35, neither the electric insulation nor the supply of the current was carried out. The thickness of the material deposited on the immersion nozzle was 13 mm, and this value indicates the worst result. Furthermore, the rates of surface defects in the products, which were produced by the slabs obtained in the second and sixth heats, were 9.8% and 11.8%, respectively.

EXAMPLE 3

By utilizing the same method as that in EXAMPLE 1, an slab having a 270 mm thickness and a 1000 mm width was produced. The vertical bending type continuous casting machine was equipped with the molten steel supplying apparatus shown in FIG. 1, wherein a gas purging part made of a porous refractory material was disposed in the upper plate of the sliding gate.

In the continuous casting, a potential of 1.5 to 25 V was applied between the one electrode and the immersion nozzle, and a DC or AC current was supplied between. When the DC current was supplied, a positive or negative potential was applied to the immersion nozzle. In several tests, no current was supplied between the one electrode and the immersion nozzle. In several tests, moreover, an Ar gas was purged at a flow rate of 20 liters (Nl)/min into the molten steel from the gas purging part disposed in the sliding gate.

After the casting, the immersion nozzle was collected and cut in the longitudinal direction in order to inspect the material deposited on the surface in the vicinity of the exit ports regarding the existence of the deposit and the state of deposition. Furthermore, the slab thus obtained was cold-rolled to form a steel strip having a thickness of 0.8 to 1.2 mm by utilizing the same method as that in EXAMPLE 1, and then the inspection was carried out regarding the rate of surface defects, using the same method as that in EXAMPLE 1. The test conditions and the obtained results are listed in the table 4.

TABLE 4

| Test No. | Type of steel | Embedded position of the other electrode (*1) | Applied voltage (V) | Supplied current (A/cm$^2$) | Type of current | Ar gas purging: Current supplying part | Ar gas purging: Upper nozzle (Nl/min) | Thickness of material deposited on inner surface of refractory material (mm) | Rate of surface defects (%) |
|---|---|---|---|---|---|---|---|---|---|
| 36 | A | A | 17 | 0.17 | DC | No | 5 | 3.0 | 1.8 |
| 37 | A | A | −17 | 0.17 | DC | No | 5 | 1.3 | 0.2 |
| 38 | A | A | 10 | 0.092 | DC | No | 5 | 3.5 | 2.1 |
| 39 | A | A | −10 | 0.092 | DC | No | 5 | 1.8 | 0.3 |
| 40 | A | A | ±17 | 0.17 | AC | No | 5 | 3.0 | 1.8 |
| 41 | A | — | — | — | — | Without Nozzle | 20 | 5.0 | 2.3 |
| 42 | A | — | — | — | — | Without Nozzle | 5 | 13 | 5.1 |

(*1) The position A at which the other electrode is embedded indicates the immersion nozzle.

In Test No. 36, a positive potential was applied to the immersion nozzle and a DC current was supplied thereto at a current density of 0.17 A/cm$^2$. The thickness of the material deposited on the inner surface of the immersion nozzle was 3.0 mm and the rate of surface defects was 1.8%.

In Test No. 37, a negative potential was applied to the immersion nozzle and the other conditions were the same as those in Test No. 36. The thickness of the material deposited on the inner surface of the immersion nozzle was 1.3 mm and the rate of surface defects was 0.2%, so that the thickness of the deposited material and the rate of surface defects were better than those in Test No. 36.

In Test No. 38, a positive potential was applied to the immersion nozzle and a DC current was supplied thereto at a current density of 0.092 A/cm$^2$. The thickness of the material deposited on the inner surface of the immersion nozzle was 3.5 mm and the rate of surface defects was 2.1%.

In Test No. 39, a negative potential was applied to the immersion nozzle and the other conditions were the same as those in Test No. 38. The thickness of the material deposited on the inner surface of the immersion nozzle was 1.8 mm and the rate of surface defects was 0.3%, so that the thickness of the deposited material and the rate of surface defects were better than those in Test No. 38.

In Test No. 40, an AC current was supplied at a current density of 0.17 A/cm$^2$ and the other conditions were the same as those in Test No. 36. The thickness of the material deposited on the inner surface of the immersion nozzle in the vicinity of the discharge holes was 3.0 mm and the rate of surface defects was 1.8%, so that the thickness of the deposited material and the rate of surface defects were similar to those in Test No. 36.

In Test No. 41, no current was supplied and an Ar gas was purged from the sliding gate into the molten steel at a flow rate of 20 liters (Nl)/min. The thickness of the material deposited on the inner surface of the immersion nozzle in the vicinity of the discharge holes was 5.0 mm and the rate of surface defects was 2.3%, so that the thickness of the deposited material and the rate of surface defects were relatively unsatisfactory.

In Test No. 42, neither the current was supplied, nor the Ar gas was purged into the molten steel from the sliding gate. In this case, the immersion nozzle clogging took place during the casting, so that the casting had to stop at the third heat. After casting, the thickness of the material deposited on the inner surface of the immersion nozzle in the vicinity of the exit ports was 13 mm and the rate of surface defects was 5.1%.

Industrial Applicability

In accordance with the apparatus for supplying molten steel according to the present invention, the deposition of Al oxide or the like in the molten steel on the inner surface of the upper nozzle, the flow control mechanism and the immersion nozzle can securely be prevented. Moreover, the application of the continuous casting method with the apparatus for supplying molten steel makes it possible to prevent the products manufactured by the obtained slab from generating the surface defects caused by defects such as mold flux, Al oxide, gas bubbles in the slab. Moreover, the continuous casting method effectively prevents the immersion nozzle clogging during the casting, thereby enabling the applicability to be provided over a wide area of the continuous casting.

What is claimed is:

1. An apparatus for supplying molten steel used for the continuous casting, compromising:

a tundish for storing the molten steel, an upper nozzle disposed in the bottom of the tundish, a flow control mechanism for controlling the flow rate of the molten steel from the tundish into a mold, an immersion nozzle for supplying the molten steel into the mold, and a pair of electrodes and a power supply connected thereto, wherein an inner surface, being in contact with the molten steel, of one of the upper nozzle, the flow control mechanism and the immersion nozzle is formed by a refractory material having an electrical conductivity not less than $1\times10^3$ S/m at a temperature not less than the melting point of steel, wherein the one electrode of the paired electrodes is disposed in one of a tundish wall, the upper nozzle, the flow control mechanism and the immersion nozzle in such a way that the one electrode is in contact with the molten steel, wherein the other electrode is disposed in a part formed by the refractory material having the electrical conductivity not less than $1\times10^3$ S/m at a temperature not less the melting point of steel.

2. An apparatus for supplying molten steel used for the continuous casting according to claim 1, wherein the refractory material having the electrical conductivity not less than $1\times10^3$ S/m at a temperature not less than the melting point of steel comprises an alumina graphite.

3. An apparatus for supplying molten steel used for the continuous casting according to claim 1 wherein an insulating element is interposed between the one electrode and the other electrode.

4. An apparatus for supplying molten steel used for the continuous casting according to claim 2, wherein an insulating element is interposed between the one electrode and the other electrode.

5. An apparatus for supplying molten steel used for the continuous casting according to claim 3, wherein a gas purging part is disposed in one or more than one of the upper nozzle, the flow control mechanism and the immersion nozzle which have no electrode.

6. An apparatus for supplying molten steel used for the continuous casting according to claim 4, wherein a gas purging part is disposed in one or more than two of the upper nozzle, the flow control mechanism and the immersion nozzle which have no electrode.

7. A continuous casting method, comprising:

a) using an apparatus for supplying molten steel used for the continuous casting, wherein the apparatus comprises
   a tundish for storing the molten steel,
   an upper nozzle disposed in the bottom of the tundish,
   a flow control mechanism for controlling the flow rate of the molten steel from the tundish into a mold, and
   an immersion nozzle for supplying the molten steel into a mold, and
   a pair of electrodes and a power supply connected thereto,
   wherein an inner surface, being in contact with the molten steel, of one of the upper nozzle, the flow control mechanism and the immersion nozzle is formed by a refractory material having an electrical conductivity not less than $1\times10^3$ S/m at a temperature not less than the melting point of steel,
   wherein the one electrode of the paired electrodes is disposed in one of a tundish wall, the upper nozzle, the flow control mechanism and the immersion nozzle in such a way that the one electrode is in contact with the molten steel,
   wherein the other electrode is disposed in a part formed by the refractory material having the electrical conductivity not less than $1\times10^3$ S/m at a temperature not less than the melting point of steel, b) supplying a molten steel stored in a tundish into a mold, and c) supplying an electric current between the inner surface of the upper nozzle, the flow control mechanism and the immersion nozzle in which the other electrode of the paired electrodes is disposed and the molten steel.

8. A continuous casting method according to claim 7, wherein, in the case of supplying a molten steel stored in a tundish into a mold, setting the electrical resistance between the one electrode and the other electrode to be not less than 500 Ω, either at the end of preheating the tundish before the molten steel is supplied to the tundish, or before the molten steel is supplied to the tundish, if the tundish which is once used for casting is recycled for casting without preheating.

9. A continuous casting method according to claim 8, wherein controlling the electrical resistance determined from the current and voltage applied between the one electrode and the other electrode during a period from the start and to the end of casting to be less than 1/10 of the electrical resistance between the one electrode and the other electrode, either at the end of preheating the tundish before the molten steel is supplied to the tundish, or before the molten steel is supplied to the tundish if the tundish which is once used for casting is recycled for casting without preheating.

10. A continuous casting method according to claim 7, wherein a current is supplied at a current density of not less than 0.001 A/cm$^2$ and less than 0.3 A/cm$^2$.

11. A continuous casting method according to claim 8, wherein a current is supplied at a current density of not less than 0.001 A/cm$^2$ and less than 0.3 A/cm$^2$.

12. A continuous casting method according to claim 7, wherein the applied voltage is not less than 0.5 V and not more than 100 V.

13. A continuous casting method according to claim 10, wherein the applied voltage is not less than 0.5 V and not more than 100 V.

14. A continuous casting method according to claim 11, wherein the applied voltage is not less than 0.5 V and not more than 100 V.

15. A continuous casting method according to claim 7, wherein, in the case of supplying a molten steel stored in a tundish into an apparatus for supplying molten steel, forming at least the immersion nozzle by a refractory material having the electrical conductivity not less than $1\times10^3$ S/m at a temperature not less than the melting point of steel, and disposing the other electrode therein, applying a negative potential to the immersion nozzle and supplying a DC current between the immersion nozzle and the molten steel passing through the inside of the immersion nozzle to prevent the immersion nozzle clogging.

16. A continuous casting method according to claim 14, wherein, in the case of supplying a molten steel stored in a tundish into an apparatus for supplying molten steel, forming at least the immersion nozzle by a refractory material having the electrical conductivity not less than $1\times10^3$ S/m at a temperature not less than the melting point of steel, and disposing the other electrode therein, applying a negative potential to the immersion nozzle and supplying a DC current between the immersion nozzle and the molten steel passing through the inside of the immersion nozzle to prevent the immersion nozzle clogging.

* * * * *